United States Patent [19]

Brady

[11] 4,070,613

[45] Jan. 24, 1978

[54] IGNITION TIMING MEASURING APPARATUS

[75] Inventor: Brian B. Brady, Minneapolis, Minn.

[73] Assignee: Applied Power Inc., Milwaukee, Wis.

[21] Appl. No.: 762,741

[22] Filed: Jan. 26, 1977

[51] Int. Cl.[2] ..... F02P 17/00

[52] U.S. Cl. ..... 324/16 T; 324/83 D

[58] Field of Search ..... 324/15, 16 R, 16 T, 324/83 D; 73/116, 118

[56] References Cited

U.S. PATENT DOCUMENTS

| | | | |
|---|---|---|---|
| 3,753,082 | 8/1973 | Crawford et al. | 324/16 |
| 3,768,004 | 10/1973 | Abnett et al. | 324/16 |
| 3,939,397 | 2/1976 | Maisonville | 324/16 |

*Primary Examiner*—John Kominski

*Attorney, Agent, or Firm*—Frederick E. Lange

[57] ABSTRACT

Apparatus for measuring the ignition timing of a multi-cylinder internal combustion engine of the type having a pulse generator for indicating when the flywheel is in a predetermined position with respect to top dead center and in which an input signal is obtained from one particular spark plug and employed to initiate a counting operation employing a series of pulses which have a definite frequency relationship to the speed of the engine. The counting operation is started at the time that the pulse from the selected plug is received and is terminated when the reference signal is received from the pulse generator. Provision is made for compensating for different reference angles between the top dead center position and the position at which the pulse generator produces a pulse. This is done by presetting a counter in accordance with the reference angle.

The apparatus can also be used as a tachometer. A digital display is employed and when the apparatus is used as a tachometer, all four of the digital display units are employed. When the apparatus is used to measure advance timing, only two of the display units are used and the third is used to display a minus sign when the ignition is retarded.

10 Claims, 7 Drawing Figures

IGNITION TIMING MEASURING APPARATUS

BACKGROUND OF THE INVENTION

For many years, it has been conventional practice in providing for the measurement and adjustment of the ignition angle of an internal combustion engine to provide a mark on the pulley of the engine which can be observed. A stroboscopic lamp is directed on the pulley to illuminate the timing mark. This stroboscopic lamp is energized under the control of ignition pulses from the ignition system. By adjusting the delay interposed between an ignition pulse from the ignition system and the firing of the lamp until the timing mark appears to be at the top dead center position, it is possible to determine the amount of ignition timing.

In recent years, it has become increasingly common to provide the engine with some means, often a notch in the pulley, for producing an electrical pulse when the crankshaft is in a predetermined position. By comparing the position of this pulse with the position of a pulse derived from the voltage applied to a particular plug, such as the "No. 1" plug of the engine, it is possible to determine the amount of angular displacement of the ignition. Unfortunately, the different manufactures of automotive vehicles place the notches or other means indicative of the position of the pulley at different points with respect to top dead center. This is partly due to the physical limitations in the placement of the pulse generator cooperating with the notch or other position indicator, due to the auxiliary equipment being employed. It is also due, in part, to the fact that different engineers have different opinions as to the most desirable location for such a pulse generator, usually a magnetic pulse generator. As a result, if a timing measurement device is to be used with different types of automobile engines, some means must be provided for correcting for these differences in displacement of the magnetic pulse generator from top dead center, this displacement commonly being referred to as the reference angle.

It has been previously proposed to generate a series of pulses each being initiated with the occurrence of an ignition pulse supplied to the No. 1 plug and each terminating upon a signal received from the magnetic pulse generator, algebraically adding to this series of pulses a voltage indicative of the reference angle and then integrating the resultant pulses to determine the reference angle. While this arrangement is quite satisfactory, it basically provides an analog output and does require calibration arrangements if the indication of timing angle is to be correct.

It has also been proposed in the Crawford et al U.S. Pat. No. 3,753,082 and the Abnett et al U.S. Pat. No. 3,768,004 to provide a pulse generator which is operated at a frequency related to the speed of engine revolution so that there is a constant number of pulses per engine revolution. By counting the number of pulses occurring between the firing of a particular plug and the signal from the reference generator, it is possible in this manner to obtain a count equal to the reference angle. The apparatus described in the above mentioned patents, however, is particularly designed for use in connection with production lines in which the reference angle is always the same and in which it is known with a fair degree of certainty whether the ignition is advanced or retarded. A switch is thus provided for selecting whether the apparatus is measuring the timing angle where the ignition is advanced or the timing angle where the ignition is retarded. When the ignition is advanced, the counting starts with the firing of the reference plug; when the ignition is retarded, the counting starts with a pulse related to the signal from the reference generator. This presupposes a knowledge of which condition exists. While this is possible in a production line, it is not possible where equipment is to be used with a wide variety of automobiles, as is the case in a typical automotive diagnostic shop or repair shop. Furthermore, the apparatus depends upon the use of a signal from the high voltage ignition source connected to the distributor mechanism since the apparatus requires a signal corresponding to the firing of each cylinder. This is done so that it is possible to measure the timing advance of each plug with respect to a pulse simulating the angular position from top dead center. The difficulty with such an arrangement is that with certain modern ignition systems, it is very difficult to connect to the ignition system at a point at which such a high voltage signal is available. While the apparatus of the above mentioned patents may be suitable for the testing of engines on a production line in which the reference angle is relatively fixed and in which it is known with a fair degree of certainty whether the ignition is advanced or retarded, the apparatus for these reasons and for a variety of other reasons is not suitable for use in testing engines of a great variety of automobiles.

SUMMARY OF THE PRESENT INVENTION

The present invention is concerned with apparatus for measuring the ignition timing of a multicylinder internal combustion engine using a pulse generator of the type which produces a pulse train having a constant number of pulses per engine revolution in which there is an indicator which automatically indicates the extent and direction of ignition advance without the use of a selector device to select whether the apparatus is being used with an engine in which the ignition is being advanced or one in which it is retarded. The apparatus of the present invention automatically determines whether the ignition is advanced or retarded and indicates this fact.

The apparatus of the present invention relies upon the fact that regardless of whether the ignition is advanced or retarded, the signal from the reference igniter, such as the No. 1 plug, always occurs prior to the signal from the reference signal means which produces a signal when the crankshaft is in a predetermined position. By setting the counting device in accordance with the reference angle for the engine being tested, the indicator indicates whether the ignition is advanced or retarded by counting the number of pulses between the pulse accompanying the firing of the reference igniter and the pulse occurring at the time of the reception of the signal from the reference signal means and comparing this count with the number of pulses corresponding to the reference angle. If the pulses counted exceed the pulses corresponding to the reference angle, then the ignition is advanced. If, on the other hand, the counted pulses are less than the pulses corresponding to the ignition angle, then the ignition is retarded.

The present apparatus is usable with engines having various reference angles. By the operation of a simple selector arrangement, the counting device is preset to operate with an an engine having any of various reference angles.

Another advantage of the apparatus of the present invention is that it is usable with engines where no convenient access can be had to any lead running from the high tension ignition source to the distributor, as is often the case with recent engines. The present apparatus merely requires connection to a lead extending to a preselected plug. Such leads are always accessible.

The apparatus of the present invention is also designed to indicate the ignition advance by a numerical digital display which indicates in degrees the amount of the ignition advance, and, if the ignition is retarded, to indicate this with a negative sign. The same digital display units can also be used to indicate the engine speed. When the digital display units are being used to indicate engine speed, all of the digital display units are employed for this purpose. When, however, the display unit is being used to indicate ignition advance, only certain of the numerals are employed for this purpose and one of the remaining units is employed to display a minus sign when the ignition is retarded.

Various other objects and features of the present invention will be apparent from a consideration of the accompanying specification, claims and drawing.

DESCRIPTION OF THE PREFERRED EMBODIMENT

Figure 1A:
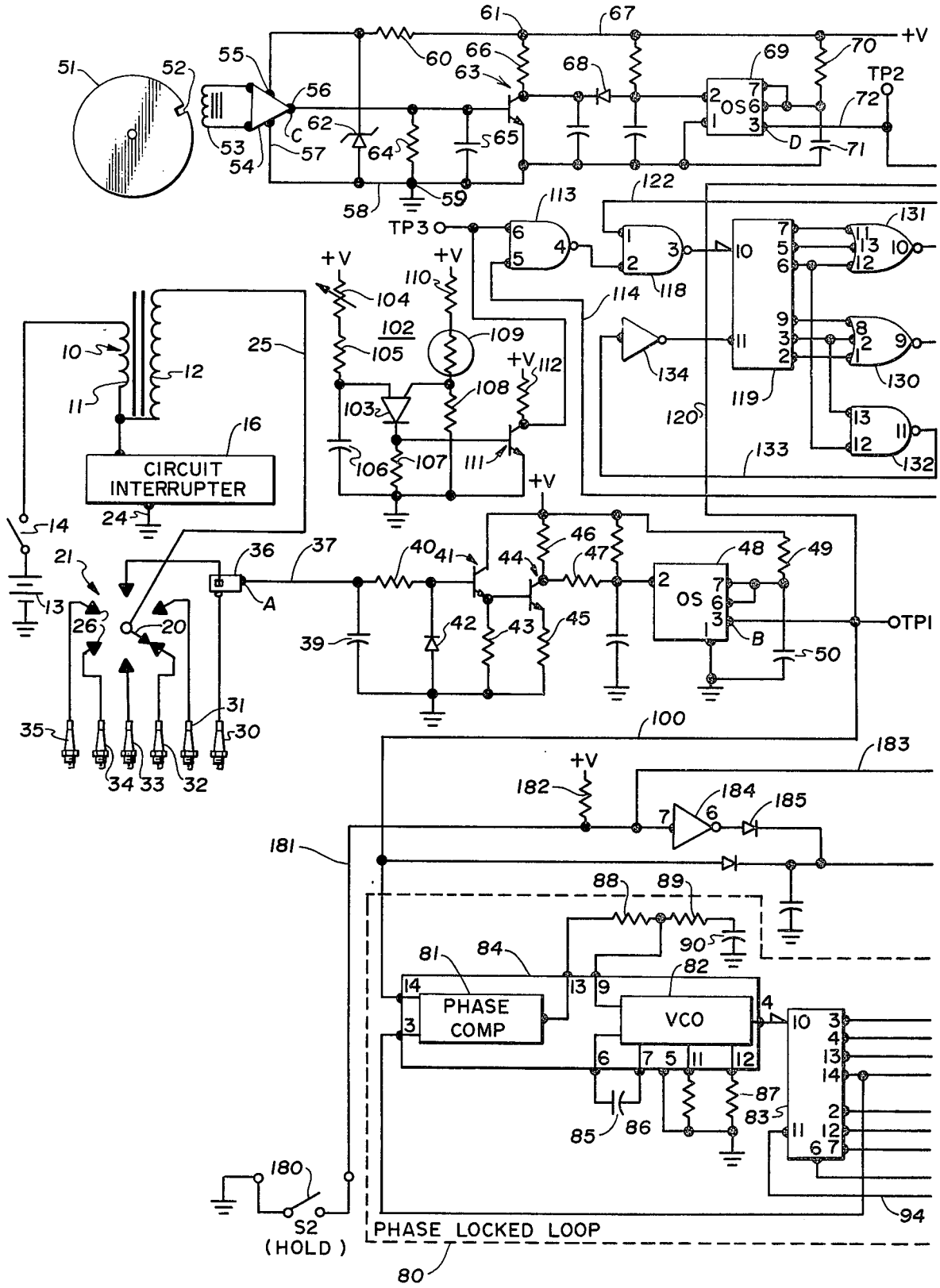
FIGS. 1*a*, 1*b* and 1*c* collectively form a schematic drawing of the apparatus of the present invention.
Figure 1B:
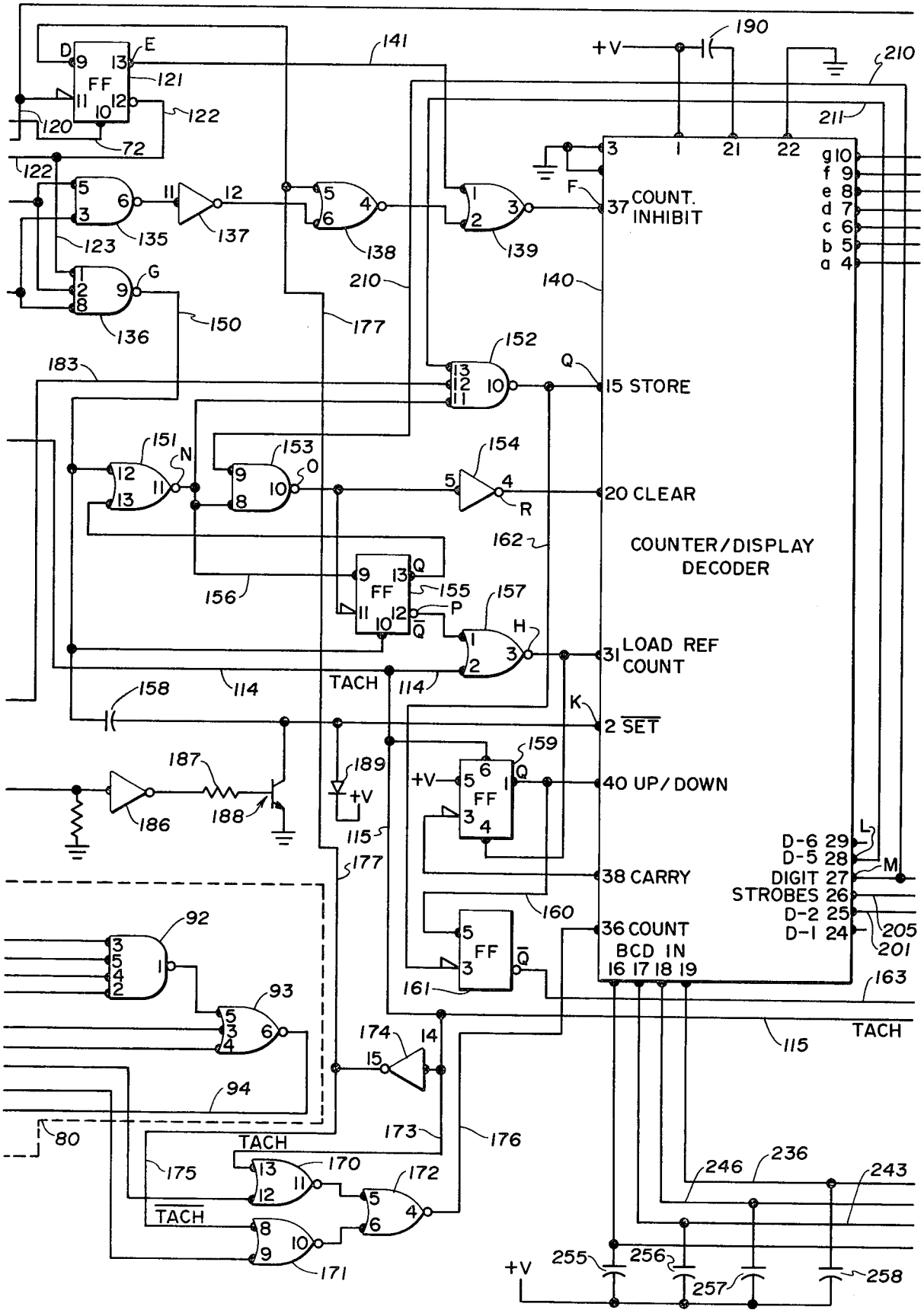
Figures 1C, 2:
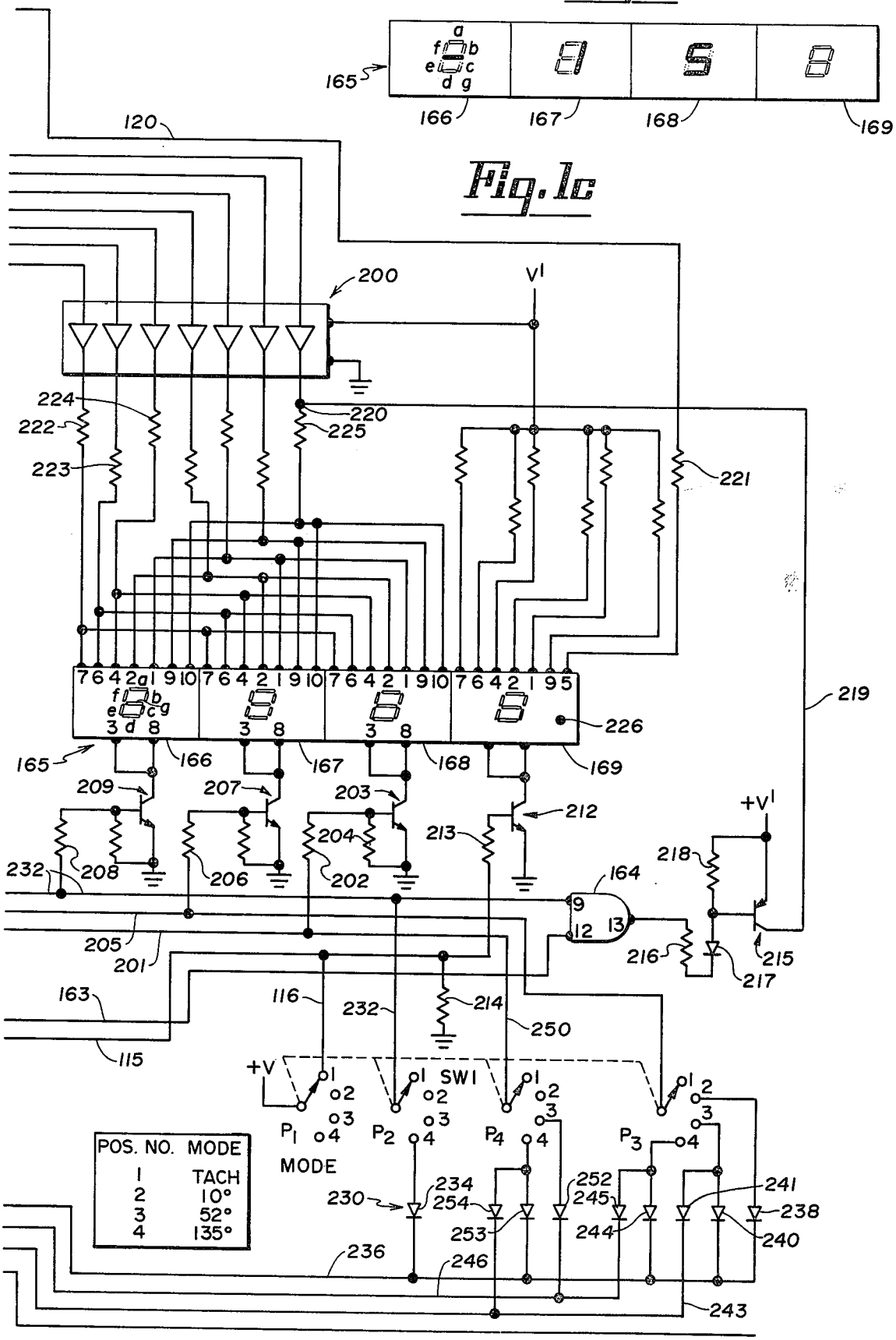
FIG. 2 is a view of the display unit showing the manner in which it is used to indicate the reference angle and more particularly the reference angle when the ignition is retarded.

Referring first to the schematic diagram of FIGS. 1*a* - 1*c*, there is shown schematically the ignition timing apparatus of the present invention connected to an automobile ignition system. Referring to this automobile ignition system, which has been illustratively shown in connection with a 6 cylinder engine, numeral 10 (FIG. 1*a*) indicates a conventional ignition coil having a low voltage primary winding 11 and a high voltage secondary winding 12. The low voltage primary winding 11 is connected to the positive terminal of the automobile battery 13 through a switch 14 which can be the usual "ignition" switch. Current flow from the positive terminal of battery 13 through primary winding 11 is controlled by a circuit interrupter 16 having a ground connection 24. The circuit interrupter is effective to interrupt, periodically, the current through the winding 11 in synchronism with the rotation of the engine's crankshaft. Commonly, this may take the form of breaker points which are periodically opened and closed. In recent years, where electronic ignition is employed, this circuit interrupter may involve a magnetic rotor having a number of teeth corresponding to the number of cylinders of the engine and which generates a series of pulses as it rotates. These pulses, in turn, control an electronic switch used to connect the primary winding 11 to ground. The measuring apparatus of the present invention may be employed with an engine having any type of circuit interrupter.

The rotary element of the circuit interrupter 16 driven by the engine is, in turn, connected through any suitable means to the distributor arm 20 of the distributor 21. The distributor arm 20 makes one complete revolution for each complete cycle of the engine which involves two complete rotations of the crankshaft of the engine. Each time that the circuit interrupter 16 is effective to interrupt current flow through the primary winding 11, an abrupt change occurs in the primary winding to cause a high voltage to be induced in the secondary winding 12. The upper terminal of secondary winding 12 is connected by means of a conductor 25 to the rotor 20. Rotor 20 is, in turn, adapted to make conductive connection with six distributor contacts 26, there being one for each cylinder of the engine. These distributor contacts are distributed uniformly around the distributor and are connected to 6 igniters 30–35. These igniters may be conventional sparkplugs commonly found in internal combustion engines.

As the distributor rotor 20 moves into conductive relationship with any one contact 26, a firing voltage is applied to that one of the sparkplugs 30–35 to which that particular contact is connected. The rotatable element (not shown) of the circuit interruptor 16 and the distributor rotor are so connected that the high voltage pulses appearing in secondary winding 12 occur at approximately the times that the distributor rotor engages the contacts 26. Thus, as the distributor rotor rotates, being driven by the engine, a firing voltage is successively applied to plugs 30–35 in sequence. It is to be understood that each of these sparkplugs 30–35 is associated with a different cylinder. While in FIG. 1*a* the sparkplugs have been illustrated as being located in a continuous row, it is to be understood that they are associated with the cylinders in such a manner as to produce a desired firing order. Also, while sparkplugs have been illustrated, it is to be understood that other forms of igniters may be employed. It is also to be understood that while the engine has been shown as having six sparkplugs, the apparatus is usable with engines having any conventional number of sparkplugs such as 2, 4 or 8 sparkplugs.

In FIG. 1*a*, sparkplug 30 is considered to be the number one plug in the firing order and to connect this No. 1 plug to the test apparatus of the present invention, an inductive pickup 36 is associated with the cable linking the distributor contact to plug 30. Regardless of the type of ignition system, such a cable is accessible. At the time that the distributor arm 20 makes contact with the distributor contact associated with No. 1 plug 30, a voltage will be induced in the pickup 36 and applied by way of a conductor 37 to the engine timing analyzer of the present invention. The voltage pulses induced in the pickup 36 are depicted in wave diagram A of FIG. 3. It will be noted that for each voltage pulse, there is an initial peak voltage followed by an oscillatory discharge. A capacitor 39 is connected between the terminal 38 and ground to cooperate with the inductive pickup 36 to enhance signal pickup. A current limiting resistor 40 is connected between terminal 38 and the base of an NPN transistor 41. A semiconductor diode 42, poled as illustrated, is connected between ground and the base electrode of transistor 41 to suppress negative going transients. Transistor 41 acts as an emitter coupled amplifier and, as such, has a resistor 43 connected between ground and its emitter electrode. The collector electrode of transistor 41 is connected to a suitable source of positive potential +V. While the power supply is not specifically illustrated, one skilled in the art can easily devise a circuit for converting battery 13 voltage or a commercial source of AC voltage to a desired D.C. potential.

The emitter electrode of transistor 41 is coupled directly to the base electrode of an NPN transistor 44 whose emitter electrode is coupled through a resistor 45 to ground and whose collector electrode is coupled through a resistor 46 to the positive voltage source +V.

The output from amplifier stage 44 is obtained at the collector junction thereof and is coupled through a resistor 47 to the trigger input terminal (pin 2) of an integrated one-shot circuit 48 bearing the legend OS. A resistor 49 coupled between the source +V and the timing terminals (pins 6 and 7) of one-shot circuit 48 and the capacitor 50 coupled between ground and pin 6 of one-shot circuit 48 determine the period that the one-shot circuit will remain in its unstable state following triggering thereof. In the preferred embodiment, the component values for resistor 49 and capacitor 50 have been selected so that the output from the one-shot circuit 48 will persist for approximately 4 milliseconds. The output pulses from the one-shot circuit 48 are shown in waveform 3 of FIG. 3. Thus far, there has been described an arrangement for producing a timing pulse of predetermined magnitude each time that the No. 1 sparkplug on the engine is fired.

The engine's pulley or flywheel is indicated schematically in the drawing by reference numeral 51. It is to be noted that this pulley has a notch 52 formed therein. The size of this notch relative to that of the pulley has been exaggerated for clarity of illustration. The pulley is secured to the crankshaft and makes two revolutions for each revolution of the distributor arm 20. Located adjacent to the pulley and in inductive relationship therewith is a variable reluctance inductive pickup coil 53. This coil is connected to the input terminal of an amplifier 54 having a power supply terminal 55, an output terminal 56 and a ground terminal 57. The coil 53 and amplifier 54 are normally in a common housing of the pulse generating unit. The ground terminal 57 of amplifier 54 is connected to a ground conductor 58 which, in turn, is connected to ground at 59. The power supply terminal 55 is connected through a resistor 60 to a junction 61 which is coupled through a conductor 67 to the source of positive potential +V. Connected between the terminal 55 and ground conductor 58 is a Zener diode 62 which may have a breakdown voltage value of 4.7 volts, for example. Thus, a voltage of approximately 4.7 volts is maintained on the input terminal 55 of the amplifier 54, the remaining portion of the +V supply being dropped across resistor 60.

Each time that the notch 52 in the pulley 51 passes the inductive coil 53, a pulse is generated in the coil 53, which pulse is amplified to produce a positive pulse at amplifier output terminal 56. These pulses are shown in waveform C of FIG. 3. It will be noted that there will be two of these pulses for each of the ignition pulses shown in waveform A of FIG. 3. This is because the crankshaft makes two revolutions for each revolution of the distributor. It will also be noted that each of the pulses of waveform C is substantially displaced from the corresponding pulses of waveform B formed as a result of the ignition pulses. Thus, the first of the pulses of waveform C occurs a substantial time after the first pulse of waveform B. The angular displacement between the pulses of waveform C and the corresponding pulse of waveform B is dependent upon two factors. In the first place, where the timing is advanced as is normally the case, the spark pulse resulting in the square wave pulse of waveform B occurs a substantial time before top dead center. In addition, the pickup 53 is so located that the pulse generated thereby occurs a substantial period of time after a piston of the No. 1 cylinder reaches top dead center. This displacement between the top dead center position and the angular position at which the pulse is produced by the coil 53 is called the reference angle. It varies with different cars depending upon the various factors determined to be desirable by the manufacturer. In some cases, the reference angle is only 10°. In other cases, it can be as much as 52½° or even 135°.

The output pulses from the amplifier 54 are applied directly to the base electrode of an NPN transistor 63. A parallel combination of a resistor 64 and a capacitor 65 is coupled between ground conductor 58 and the base electrode of transistor 63. The resistor 64 and capacitor 65 provide a shunt path for spurious signals so that only the magnetic probe signal is of sufficient amplitude to cause the transistor 63 to conduct. The collector electrode of transistor 63 is coupled through a load resistor 66 to the +V voltage bus 67 while the emitter electrode thereof is coupled to the ground bus 58.

When transistor 63 is made to conduct, a negative signal is produced at its collector electrode and applied by way of a diode 68 to the trigger input terminal (pin 2) of another semi-conductor integrated one-shot circuit 69 designated by the letters OS. As was the case with the one-shot circuit 48, a resistor 70 and a capacitor 71 determine the unstable period of the output from the one-shot circuit 69 which appears at the terminal 3 to which output line 72 is connected and which is generally shown in waveform D of FIG. 3. The values of resistor 70 and capacitor 71 are chosen so that the one-shot circuit 69 also produces an output signal of approximately 4 milliseconds duration each time a trigger impulse is applied to pin 2 thereof.

In order to perform either the tachometer or the timing measurement, it is necessary to develop a pulse train which is proportional to the rate of rotation of the engine shaft. This function is performed by the circuitry enclosed by the dashed line box 80 in FIGS. 1*a* and 1*b*. This circuitry is referred to as a "phase-locked loop" and includes a phase comparator 81, a voltage controlled oscillator (VCO) 82 and a feedback counter 83. Actually, the phase comparator 81 and the VCO 82 may comprise a single integrated circuit chip of Type No. CD4046A manufactured and sold by the RCA Corporation. This chip is represented by numeral 84 in FIG. 1*a*. As is set forth in the RCA Technotes describing this IC device, capacitor 85 and a resistor 86 are used to determine the frequency range of the VCO. The resistor 87 connected to pin 12 of the IC chip 84 enables the VCO to have a frequency offset. The output from the phase comparator 81 appears at pin 13 and is coupled through a resistor 88 to pin 9 of the chip 84 which is the input to the VCO 82. The output of VCO 82 appears at pin 4 of the integrated circuit chip 84 and is coupled to the clock (Cll) input terminal 10 of the feedback counter 83.

The output of the phase comparator 81 controls the frequency of the VCO via the network comprised of resistors 88 and 89 and the capacitor 90. The frequency range of the VCO is preferably 3,000Hz to 18,000Hz and is established by the capacitor 85 and the resistors 86 and 87. The output from the VCO clocks the counter 83, as already mentioned. Counter 83 may comprise a 12-stage ripple-carry binary counter/divider of the type manufactured and sold by RCA Corporation under the Part No. CD4040A. Again, by referring to the Technotes published by RCA Corporation for this part, it will be seen that the output from stages $Q_5$, $Q_7$, $Q_8$, and $Q_{10}$, appearing at pins 3, 4, 13, and 14, respectively, are applied as inputs to a four input NAND gate 92 (FIG. 1*b*). Similarly, the output from stages $Q_6$ and $Q_9$, appearing at pins 2 and 12, respectively, are applied as two inputs to a NOR gate 93. A third input to NOR gate 93 comes from the output pin 1 of NAND gate 92. The output from NOR gate 93 is fed back by way of a conductor 94 to the reset terminal (pin 11) of the IC chip 83.

With the connections made in this fashion, it will be seen that the output from the VCO applied to ClK input terminal (pin 10) of IC chip 83 causes the counter 83 to advance to a binary value of 1011010000 ($720_{10}$). At this count, the output of NOR gate 93 goes positive, causing the counter 83 to be reset. Thus, the counter output from stage $Q_{10}$, appearing at pin 14, has a positive-going transition every 720 counts and this positive pulse is applied to input pin 3 of the phaselocked loop chip 84.

The output from the ignition one-shot circuit 48 is applied by way of conductor 100 to pin 14 of the phaselocked loop chip 84 such that the output of the phase comparator 81 operates on the VCO to cause the positive transition from stage $Q_{10}$ (appearing at pin 14) of the feedback counter 83 to coincide with the positive transition of the output from the one-shot circuit 48. The loop will maintain a locked condition as the period between pulses out of the one-shot circuit 48 varies from 720/18,000 seconds to 720/3,000 seconds. This is equivalent to 25 pulses per second and 4.166 pulses per second or 1,500 and 250 pulses per minute, respectively. Considering that there are two crankshaft revolutions for each pulse out of the one-shot 48, this corresponds to an engine speed range of from 500 RPM to 3,000 RPM which covers the range of practical interest. Under these conditions, the $Q_2$ output of the counter 83 (obtained at pin 7) will be one-fourth of the clock frequency, i.e., 180 pulses per engine cycle (two revolutions of the crankshaft) and thus one pulse will occur for each 4° increment of engine shaft rotation. This signal will be employed in the timing measurement mode of operation of the present invention. The output from stage $Q_3$ (pin 6) of the feedback counter 83 provides a signal which is 90 pulses per timing cycle and this signal is employed when the device is operating in the so-called tachometer mode.

Referring again to FIG. 1*a*, the device of the present invention includes a tachometer oscillator indicated generally by numeral 102. Included as its active element is a unijunction device 103 having an anode electrode, a cathode electrode and a control gate. A series combination of a variable resistor 104 and a fixed resistor 105 is coupled between a source of positive potential +V and the anode electrode. A capacitor 106 is coupled between the anode electrode and ground. The cathode of device 103 is coupled through a resistor 107 to ground. The gate electrode is coupled to ground by way of a resistor 108 and to a source of positive potential +V by way of a temperature-dependent resistor 109 and a fixed resistor 110. The temperature-dependent resistor 109 tends to compensate for the effect of temperature on other components of the oscillator to minimize the effects of temperature on oscillator frequency. An NPN transistor 111 is also included as part of the tachometer oscillator 102. It has its base electrode coupled to the junction between the cathode of unijunction device 103 and the resistor 107. The emitter electrode of transistor 111 is connected to ground and the collector thereof is coupled through a load resistor 112 to the source of positive potential +V. The output from the oscillator appears at the collector electrode of the transistor 111. The tachometer oscillator 102 is of the relaxation type. The resistor 104 controls the charging rate of the capacitor 106 and is adjusted so that the anode of the unijunction device 103 will reach firing potential in a predetermined period. When the capacitor 106 discharges through device 103 and the resistor 107, current also flows into the base of the transistor 111 to generate negative-going pulses at a repetition rate of 29.25 Hz at the input pin 6 of a NAND gate 113. T is signal will be employed to establish the tachometer measurement interval.

The other input to gate 113, introduced at pin 5, arrives by way of conductors 114, 115 (FIG. 1*b*) and 116 (FIG. 1*c*) from a multi-position mode control switch SW. The output from the NAND gate 113 is applied as a first input to another NAND gate 118 at pin 2. The output from this last mentioned NAND gate is applied to the clock input terminal (pin 10) of a "divide-by-40" counter 119.

The timing pulses from one-shot circuit 48, based upon the ignition pulses applied to the No. 1 plug, are also applied by way of a conductor 120 to the clock input terminal (pin 11) of a D-type flip-flop 121 (FIG. 1*b*). The flip-flop 121 has its reset input terminal (pin 10) connected to the output from the one-shot circuit 69. The complementary output terminal Q (pin 12) is connected by a conductor 122 to a second input (pin 1) of the NAND gate 118.

The output from stages 1, 5 and 6 (pins 9, 3 and 2, respectively) of the counter 119 are applied as inputs to a NOR gate 130 while the outputs from stages 2, 4 and 3 (pins 7, 5, and 6, respectively) of the counter 119 are connected as inputs to a NOR gate 131. The outputs from stages $Q_4$ and $Q_6$ (pins 5 and 3) of the counter 119 are also applied as inputs to a NAND gate 132 whose output is coupled by way of a conductor 133 and an inverter 134 to the reset input terminal of the divide-by-40 counter 119.

NOR gate 130 and 131 each apply an input to NAND gates 135 and 136 (FIG. 1*b*). NAND gate 136 has an additional input which comes by way of conductors 122 and 123 from the $\overline{Q}$ output of flip-flop 121 at pin 12. The output from gate 135 is coupled by means of an inverter 137 to a first input terminal of NOR gate 138. The output from this gate is applied as an input to an additional NOR gate 139 whose second input is connected by a conductor 141 to the true output, Q, of the flip-flop 121 appearing at pin 13, which output is shown in waveform E of FIG. 3. The output from NOR gate 139 is applied to the "count inhibit" input (pin 37) of a Counter/Display Decoder integrated circuit chip 140, this counter being enabled when flip-flop 121 is in its set state. This last mentioned integrated circuit chip may be a type MK50395N manufactured and sold by the Mostek Corporation. The input to the count-inhibit pin 37 is shown in waveform F of FIG. 3.

The Counter/Display Decoder 140 is comprised of a six-decade up-down counter and a corresponding six-decade display register. This is the counter in which the measured parameters are accumulated and will hereinafter be referred to as the "main couner".

The output from NAND gate 136, shown in waveform G, is applied by way of a conductor 150 to a first input terminal (pin 12) of a NOR gate 151. The output of this last mentioned gate at pin 11 is connected as a first input of NAND gate 152 whose output pin 10 is connected to the Store terminal (pin 15) of the Counter/Display Decoder 140. The output from NOR gate 151 is also applied to input pin 8 of NAND gate 153, whose output is fed through an inverter 154 to the Clear input terminal (pin 20) of IC chip 140. The output at pin 10 of NAND gate 153 is also connected to the Clock input terminal 11 of a D-type flip-flop 155. The output from NOR gate 151 is connected to the data input terminal (pin 9) of flip-flop 155 by way of a conductor 156. The Q output from flip-flop 155 is coupled back as a second input to the NOR gate 151. The complementary output, $\overline{Q}$, from flip-flop 155 is applied as a first input to NOR gate 157 whose output, shown in waveform H, is connected to the "Load Reference Count" input (pin 31) of IC chip 140. The second input of NOR gate 157 comes from the mode selector switch SW, by way of conductors 116, 115 and 114.

The output from NAND gate 136, which appears on conductor 150, is coupled through a capacitor 158 to the $\overline{SET}$ input (pin 2) of the Counter/Display Decoder chip 140. A flip-flop 159 is also provided and is reset by the output from NOR gate 157. The carry output (pin 38) of the chip 140 will clock flip-flop 159 into a set condition. Mode control signals appearing on the conductor 115 can force flip-flop 159 into a continuous set condition for tach measurements. The output from the flip-flop 159 is connected to the up/down (increment-/decrement) input terminal (pin 40) of IC chip 140. The Q output from flip-flop 159 is connected by a conductor 160 to the D input of a D-type flip-flop 161. This flip-flop receives its Clock input from the output of NAND gate 152 by way of a conductor 162. The complementary output $\overline{Q}$ from flip-flop 161 is applied by a conductor 163 to a first input of a NAND gate 164 which is used to control the illumination of a minus sign in the LED display device (indicated generally by numeral 165), all as will be later explained when the operation of the engine timing analyzer of the present invention is set forth.

A set of three NOR gates, namely, gates 170, 171 and 172 are used to couple selected outputs of the feedback counter 83 in the phase-locked loop 80 to the "Count" input terminal (pin 36) of the Counter/Display Decoder chip 140. More specifically, the output from stage $Q_2$ (pin 7) of the feedback counter 83 is connected as a first input to NOR gate 170. The signal from the mode control switch SW, appearing on conductor 115 is also applied by way of conductor 173 to the second input terminal of NOR gate 170 while the inverted version of this same signal is applied by way of inverter 174 and conductor 175 to the second input of NOR gate 171. Gates 170 and 171 each provide an input to NOR gate 172 on a mutually exclusive basis and the output from gate 172 is connected by way of conductor 176 to the aforementioned Count input terminal 36 of the IC chip 140. The output from inverter 174 is also applied by way of the conductor 177 to a second input of NOR gate 138 and to the D-input of flip-flop 121.

Referring to FIG. 1*a*, a single pole single throw switch 180 is included for selectively applying a ground signal to the conductor 181. For reasons which will become more apparent when the operation of the device is explained, this switch is referred to as the "hold" switch. Conductor 181 is also coupled to a source of positive potential +V by means of a resistor 182. Thus, when the switch 180 is open, the potential on line 181 will be relatively high, whereas when the switch 180 is closed, it will be relatively low. A conductor 183 joins conductor 181 to a second input terminal (pin 12) of the NAND gate 152. The series combination of an inverter 184 and a diode 185 are connected between conductor 181 and the input of an inverter 186 whose output is coupled through a resistor 187 to the base electrode of a NPN transistor 188. The emitter electrode of transistor 188 is connected to ground while its collector is coupled to the $\overline{SET}$ input terminal 2 of the IC chip 140. A diode 189 is connected between this same $\overline{SET}$ input and the positive voltage source +V to bypass any transient voltages greater in magnitude than the voltage source.

Output pins 4 through 10 of the counter/display decoder chip 140 are individually coupled through buffer amplifiers indicated generally by numeral 200 and series resistors 222, 223, 224 etc. to the input terminals of the seven-segment display device 165. The display device 165 is comprised of four stages 166 through 169, each capable of indicating the decimal digits) through 9 depending upon which of the seven segments *a, b, c, d, e, f* and *g* thereof are selected for illumination. While light emitting diodes (LEDS) are employed to define the segments, it is of course possible to utilize other display mechanisms such as Nixie tubes or liquid crystal devices without departing from the teachings of this invention.

Communication to the LED display circuits is by way of the segment outputs *a* through *g* and the digit strobe outputs $D_1$ through $D_6$, appearing at pins 24 through 29, respectively. To understand the operation, consider the action of the display circuit when the digit strobe $D_4$ (pin 27) is scanned. The positive output pulse passes through resistor 208 and is effective to turn on the transistor switch 209, thus grounding the cathodes of all LED segments associated with the LED array 166. At the same time, the contents of the fourth digit in the internal display register are decoded to engerize the specific segment outputs required to form the corresponding numerical symbol. For example, if the value were 7, then segment outputs *a, b* and *c* would be positive, causing the output of the corresponding buffer amplifiers to go positive, thus conducting current through segments *a, b* and *c* of the display element 166 via resistors 222, 223 and 224.

In a similar manner, as will be described, the digit strobe outputs $D_3$ (pin 26) and $D_2$ (pin 25) will sequentially control the turning on of transistor switches 207 and 203 to thereby allow the display of a numerical symbol in stages 167 and 168 of the LED display device 165. The particular symbol displayed, of course, is determined by the segment outputs emanating from pins 4 through 10 of the counter/display decoder chip 140.

A capacitor 190 sets the timing on an internal clock contained within the counter/display decoder chip 140 to control the scan rate, i.e., the rate at which the digit strobe pulses are produced. Scanning is performed sequentially from the most significant digit, $D_6$ (pin 29) to the least significant digit, $D_1$ pin 24) in a continuous cyclic manner, concurrent with all other counter activity, unless inhibited by a low signal on the SET input (pin 2). In the present embodiment, the digit strobes $D_2$ (pin 25), $D_3$ (pin 26) and $D_4$ (pin 27), are used to control the three most significant display digits 168, 167 and 166, respectively. Digit strobes $D_5$ (pin 28) and $D_4$ (pin 27) are used for timing while digit strobes $D_1$ (pin 24) and $D_4$ (pin 29) are unused.

Digit strobe $D_2$ obtained at pin 25 of the IC chip 140 is applied by way of a conductor 201 and a resistor 202 to the base electrode of an NPN transistor switch 203. The emitter electrode of this transistor is connected directly to ground and a bias resistor 204 is coupled between its base electrode and ground. The collector electrode of transistor 203 is connected to control terminals (pins 3 and 8) of stage 168 of the display device 165. In a similar fashion,; digit strobe $D_3$ appearing at pin 26 on the IC chip 140 is applied by way of conductor 205 and resistor 206 to the base electrode of a transistor switch 207 associated with stage 167 of the display device. As has been described, strobe digit $D_4$ appearing at pin 27 is applied via a resistor 208 to the base electrode of a transistor switch 209 to connect terminals of stage 166 of the display device 165 to ground. The strobe digit $D_4$ appearing at pin 27 is also applied by way of a conductor 210 to a second input on the NAND gate 153. Strobe digit $D_5$ appearing at pin 28 is applied by way of a conductor 211 to a third input on NAND gate 152.

The lowest order stage 169 of the display device 165 also has associated with it a transistor switch 212 which is connected to the mode control switch SW., yet to be described, by conductor 115 and a resistor 213. A resistor 214 is disposed between the conductor 115 and ground. As will be described later, display stage 169 always indicates "zero" when turned on.

Digit strobe $D_4$ appearing at pin 27, is also connected to the second input terminal of NAND gate 164. The output from this NAND gate is coupled to the base electrode of a PNP transistor 215 by means of a series connection of a resistor 216 and a diode 217. The collector electrode of transistor 215 is tied to the positive voltage source +V' and a resistor 218 connects this voltage source to the base electrode of the transistor 215. The collector electrode of transistor 215 is connected by a conductor 219 to a junction point 220 associated with segment output *g* of the counter/display decoder 140. The output from the one-shot circuit 48 is applied to a decimal point indication 226 of the lowest order stage 169 of the display device 165 by means of conductor 120 and a series resistor 221.

The four-pole, multi-positioned ganged switch shown at the bottom of FIG. 1*c* provides a means whereby an operator may select the tach mode or the timing mode of operation of the analyzer unit and also enter in predetermined reference angles, thus allowing the analyzer unit to be utilized with a variety of automobile engines. The mode control switch is illustrated as being in the so-called tachometer mode wherein engine RPM is sampled and displayed in the display register 165. In this mode, pole $P_1$ which is connected to a source of positive potential +V, is connected by way of the conductor 116 to the tach line or bus 115. None of the other poles $P_2$, $P_3$ or $P_4$ are connected to anything. The arrangement of the diodes, indicated generally by numeral 230, provides a means whereby predetermined binary coded decimal digits corresponding to desired engine reference angles may be entered into the counter/display decoder chip 140. As is indicated, the digit strobe $D_4$ output from the chip 140 appearing on pin 27 is applied by way of a conductor 232 to pole $P_2$ of the multi-position switch and contact 4 associated with this pole is coupled through a diode 234 to a bus 236 connected to input pin 19 of the counter/display decoder chip 140. Similarly, pole $P_3$ is connected to digit strobe $D_3$ (pin 26) by way of a conductor 205 and contact 2 associated with this pole is coupled through a diode 238 to the bus 236. Contact 3 associated with pole $P_3$ is coupled through diodes 240 and 241 to the bus 236 and to a bus 243 which is connected to BCD input pin 17 on the chip 140. The contact 4 associated with pole $P_3$ of the manually operated switch is coupled through a diode 244 to the bus 236 and through a diode 245 to a bus 246 which is connected to BCD input pin 18 on the chip 140. Likewise, pole $P_4$ of the switch is connected by a conductor 250 and conductor 201 to strobe digit $D_2$ (pin 25) of the chip 140. The switch contact 3 associated with pole $P_4$ is coupled through a diode 252 to the bus 246 and contact 4 is connected through diodes 253 and 254 to the buses 236 and 243, respectively. Capacitors 255 through 258 (FIG. 1*b*) are coupled between a source of positive voltage +V and the buses leading to the BCD input pins 16 through 19.

This completes the description of the construction and layout of the preferred embodiment of the engine analyzer of the present invention. Now that this has been accomplished, consideration will be given to the manner of operation.

OPERATION-TIMING MEASUREMENT MODE

Figure 3:
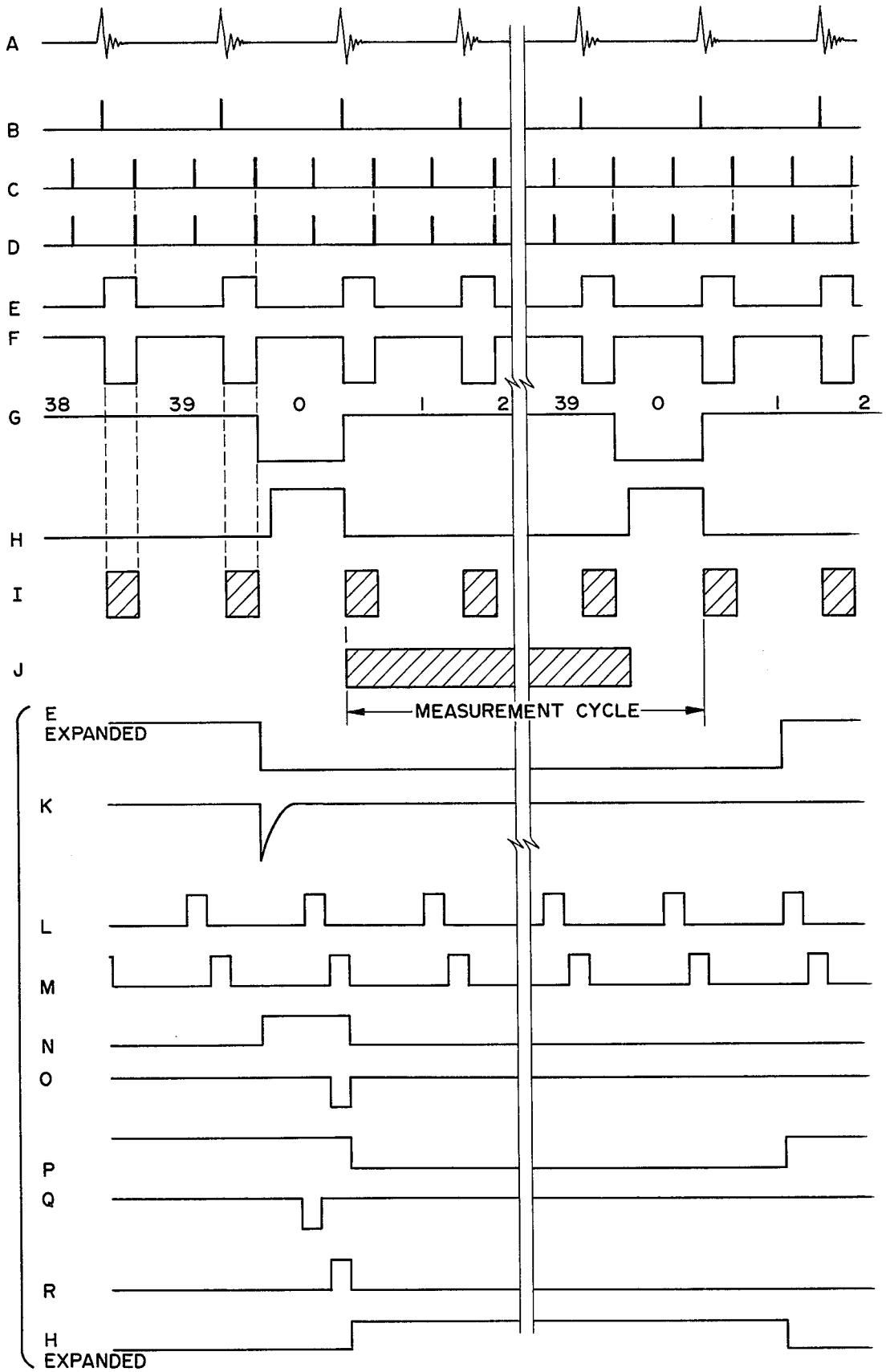
FIG. 3 is a view showing waveforms of the voltages at various points in the circuit of FIGS. 1*a*, 1*b*, and 1*c*.

In describing the operation of the apparatus, reference will first be made to FIGS. 3, 4 and 5. FIG. 3 has already been referred to in identifying various waveforms. In addition to the waveforms already mentioned, waveforms G, H and I are in the same time scale as waveforms A through F. It is of course understood that the amplitude is purely illustrative and has no relation to the actual amplitude of the waveforms. Waveform J refers to the operation of the unit as a tachometer and will be discussed later. The lower 10 waveforms, all of which are bracketed on the left hand side, are on an expanded scale to better identify the operation. Waveforms "E Expanded" and "H Expanded" correspond to waveforms E and H in the upper portion of FIG. 3. All of the waveforms will be referred to in the subsequent discussion.

Figure 4:
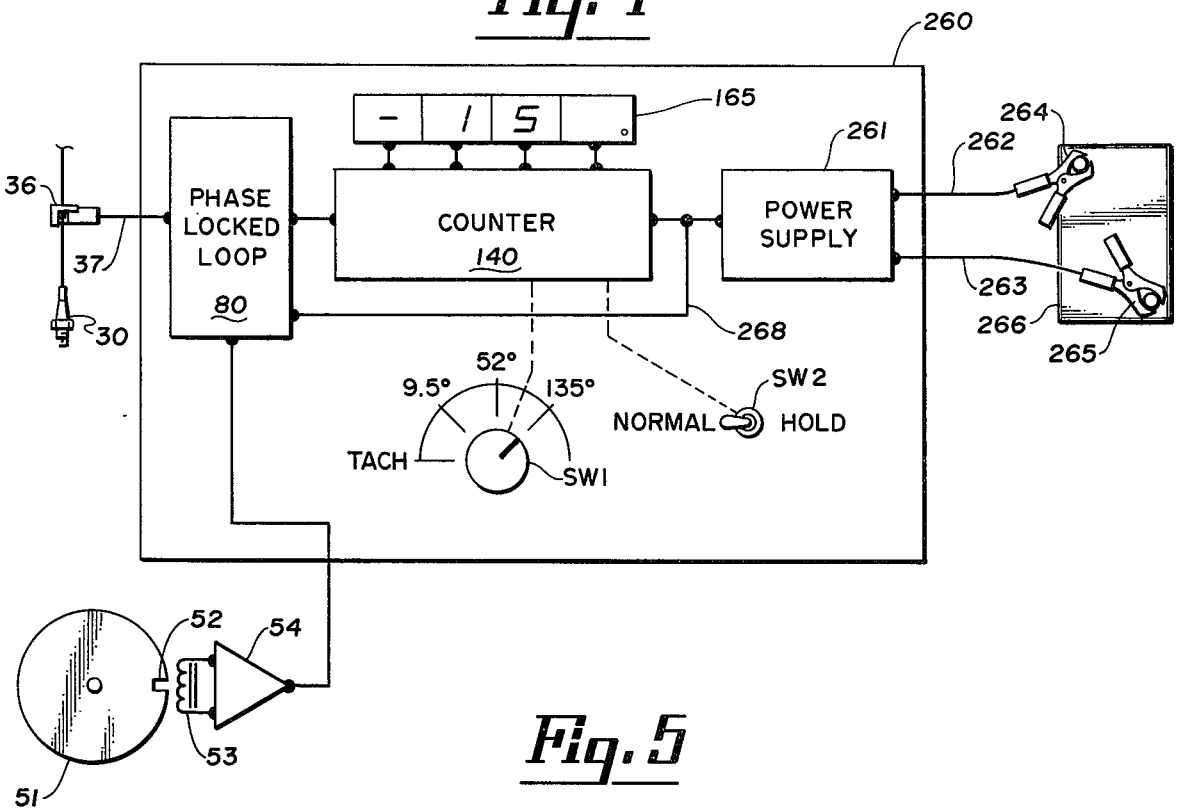
FIG. 4 is a simplified block diagram of the apparatus.

In FIG. 4, there is depicted a simplified diagrammatic showing of the apparatus and the manner in which it is connected. The equipment is shown as being housed within a housing 260. The apparatus is shown as comprising a phaselocked loop 80 which has two inputs, one the lead 37 which is connected to the pickup 36 which connects to the lead to the No. 1 plug 30. The other input is from the amplifier 54 which is connected to the coil 53 associated with the reference notch 52 of the pulley 51. This input produces a pulse responsive to a predetermined position of the crankshaft. The phaselocked loop is shown as controlling the counter 140 which in turn controls the display device 165. In the preceding description, reference has been made to a source of voltage. In FIG. 4, this is identified as a power supply 261 which has input conductors 262 and 263 leading to alligator clips 264 and 265 which are designed to fit over the terminals of a battery 266. The selector switch SW1 is shown as controlling the counter 140. As will be recalled, this selector switch has a tach position in which the counter acts to supply the display device 165 with a reading of the speed of the engine. The remaining three positions of the switch SW1 are designed to provide for three different reference angles, namely, 9½°, 52° and 135°. In the actual operation of the apparatus, the reference angle for which the counter is preset when the selector switch SW1 is in the 9½° position is 10° rather than 9½°.

The switch S2 is also shown. This is shown as having two positions, the "Normal" position and the "Hold" position. Reference has been previously made to this.

Figure 5:
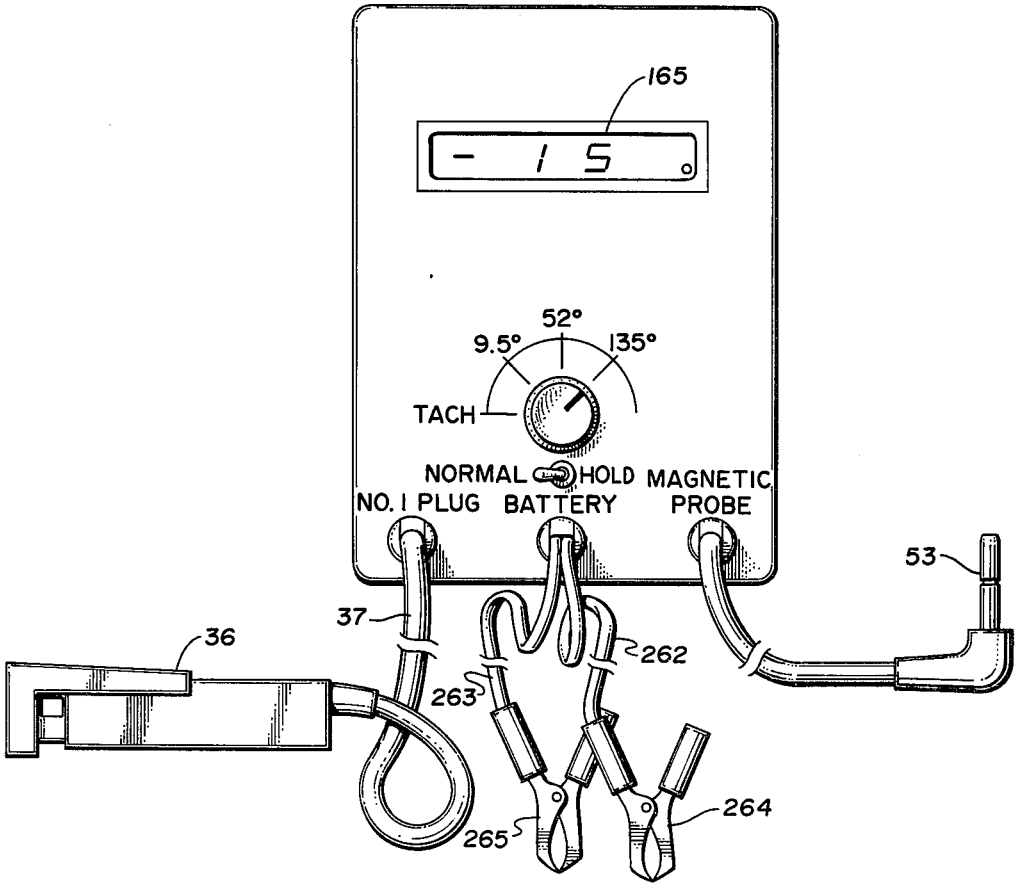
FIG. 5 is an elevational view showing the commercial form of the apparatus.

FIG. 5 is similar to FIG. 4 except that it indicates the form which the commercial device actually takes. It is believed that a description of this is unnecessary since the structure is obvious from FIG. 4 and the previous description of the apparatus in connection with FIGS. 1*a*, 1*b* and 1*c*.

In operation, pickup 36 is attached to the lead of the No. 1 sparkplug 30 so that a series of pulses such as shown in waveform A of FIG. 3 periodically drives transistors 41 and 44 into conduction to produce a negative impulse at the trigger input terminal of the one-shot circuit 48. The output of the one-shot circuit is a short pulse of constant amplitude, these pulses being schematically shown in waveform B of FIG. 3.

At the same time, the magnetic pickup including coil 53 is placed adjacent the pulley 51 so as to be in a position to sense the notch 52. The voltages resulting from the coil 53 sensing the notch 52 are shown in waveform C of FIG. 3. These signals are filtered and amplified and supplied to the one-shot circuit 69 so that at the output of the one-shot are a series of pulses of constant amplitude, each pulse occurring at the time of the coil 53 sensing the notch 52.

To perform the timing measurement, it is first necessary to set the counter 140 in accordance with the reference angle. This is done by setting the counter with a count corresponding to ten times the reference angle. The counter is decremented each 4° of rotation over an interval which begins with the firing of the No. 1 cylinder and ends when the timing notch 52 is sensed. This action is performed over a total of 40 consecutive timing intervals which comprise the measurement cycle. At the end of the measurement cycle, there will have been ten counts accumulated for each degree of angular displacement, thus the remaining count will be equal to ten times the angle of ignition with respect to Top Dead Center. By utilizing multiple timing cycles per measurement cycle, the uncertainty associated with the least significant bit is reduced and error associated with instantaneous variation in engine speed will tend to be averaged out.

Pole $P_1$ of the manually operated selector switch SW determines the mode of measurement to take place. Position 1 is associated with the tachometer or speed measurement while positions 2, 3 and 4 are associated with the timing mode to provide reference angle inputs of 10°, 52° and 135°, respectively. For any of the timing mode positions, the mode control line 116 is disconnected from the +V voltage supply and is thus in a binary low state to condition the control logic for the timing mode. Specifically, transistor 212 will be nonconductive, thereby precluding digit display in the register stage 169. Also, with the positive voltage +V removed from the tach bus 115, NOR gate 170 is enabled and NOR gate 171 is disabled. As such, the output from stage $Q_2$ (pin 9) of the counter 83 will pass through gate 170 and gate 172 to advance the count stored in the main counter 140 at 180 360 pulses per timing cycle rate. With the +V signal removed from the tach bus 115, NOR gate 157 will be enabled, NOR gate 138 will be disabled, NAND gate 113 will be disabled, inverter 174 will output a "High" signal, and hence a binary "1" signal is applied to the D-input (pin 9) of the D-type flip-flop 121 so that the flip-flop will always be clocked to its set state. Flip-flop 121 establishes the count interval and is clocked by the output signal (waveform B of FIG. 3) from the one-shot circuit 48 (controlled by the signal from the No. 1 plug-waveform A) and is reset by the output (wveform D) from the one-shot circuit 69 (controlled by the magnetic reference signal-waveform C). The output of flip-flop 121 is shown in waveform E. The output from inverter 174 s also applied by way of conductor 177 to an input of NOR gate 138, forcing its output low and partially enabling NOR gate 139. Therefore, the setting of flip-flop 121 controls the count inhibit of the main counter 140 shown as waveform F. Thus, the counter 140 is enabled only when flip-flop 121 is in its set state.

The mode control line 116 maintains NAND gate 113 in a "1" state. Hence, resetting of flip-flop 121 by the pulse output from one-shot circuit 69 causes a negative transition of the output from NAND gate 118. This negative transition causes the divide-by-40 counter 119 to be incremented.

When a binary count of 101000 ($40_{10}$) is reached, counter 119 is reset by way of the output from NAND gate 132 and inverter 134. Stated differently, the counter 119 is reset every 40th clock pulse. The resetting of counter 119 causes NOR gates 131 and 130 to produce a high output and therefore, NAND gate 136 produces a low output, shown as waveform G. This negative transition is coupled by way of conductor 150 and the capacitor 158 to the $\overline{\text{SET}}$ input (pin 2) of the main counter 140. When this $\overline{\text{SET}}$ input momentarily goes low as shown in waveform K, the internal "scan" counter contained within the counter/display decoder IC chip 140 is reset. When the capacitor 158 has discharged, the scanning process resumes, starting with digit strobe $D_6$. The negative transition from NAND gate 136 also causes NOR gate 151 to produce a high output shown in waveform N, thereby enabling NAND gate 152. When the digit strobe $D_5$ at pin 28 is produced (waveform L), a signal passes by way of conductor 211 to fully enable NAND gate 152, causing its output to assume a binary low condition. This low signal is applied to pin 15 of the counter/display decoder 140 to cause a "store" operation to take place, as shown in waveform Q. The store operation effects a transfer of the contents of the counter stages contained within IC device 140 to the dislay register also contained in the device 140. The contents of the counter, of course, are the results of the previous measurement cycle. However, if the hold switch 180 is closed, the ground signal applied by way of conductors 181 and 183 to the NAND gate 152 to inhibit the production of the "store" signal and the store operation is thereby inhibited and the previous count remains in the internal register so that the reading of the display device remains unchanged.

Next in sequence, the pulse on digit strobe $D_4$ at pin 27 shown in waveform M passes by way of conductor 210 to an input of NAND gate 153 causing its output to go low (waveform O) and thereby generating a positive pulse at the output of inverter 154. This positive pulse (waveform K) serves to clear the counter in the counter/display decoder 140. The trailing edge of the digit strobe $D_4$ (waveform M) clocks the flip-flop 155 to its set state (waveform P), thus causing NOR gate 151 to produce a low output (waveform N) which inhibits NAND gates 153 and 152. When the flip-flop 155 sets (waveform P), NOR gate 157 produces a high output to reset flip-flop 159 and to enable the loading of an externally specified reference counter into the counter/display decoder device 140 (as shown in waveforms H and "H Expanded".

As a first example, consider the case where the switch $SW_1$ is in position 4. The digit strobe $D_4$ pulse emanating from pin 27 conducts through diode 234 causing pin 19 of the BCD input to go high and setting the fourth digit of the counter to 1. Next, the digit strobe $D_3$ pulse emanates from pin 26 of the counter 140 and passes by way of conductor 205 and diodes 244 and 245 to cause the BCD inputs 19 and 16 to go high which causes the third digit of the counter to register a value of 3. Finally, the digit strobe $D_2$ pulse from pin 25 conducts through diode 253 and 254, causing BCD inputs 19 and 17 to go high, forcing a value of 5 into the second digit of the counter. The first digit of the counter had been previously cleared and remains unchanged. In this manner, the counter has been initialized with a count of 1350 which corresponds to a reference angle of 135°.

By examining the arrangement of diodes with respect to the various positions of the selector switch $SW_1$ and the manner in which these diodes are connected to the BCD inputs of the counter/display decoder 140, it can be seen that switch position 2 employs a diode 238 to establish a reference count of 100 while switch position 3 employs diodes 240, 241 and 252 to establish a reference count of 520. Additional switch positions and diodes can, of course, be added to provide any additional reference counts which may be desired. The capacitors 255 through 258 protect the BCD inputs from line-to-line crosstalk due to the junction capacitance of the unselected diodes. Thus, it has been shown how the selector switch $SW_1$ can be used to enter a desired predetermined reference angle of 10°, 52° or 135°. For convenience, the small legend located next to the selector switch and diode array indicates the switch position to be used for entering any one of the three desired reference angles as well as the switch position for causing the analyzer to display engine speed.

With the operator having entered in a predetermined reference angle corresponding to the particular car manufacturer's specifications, the counter/display decoder 140 is completely initialized and ready to begin a timing measurement cycle. At the time that flip-flop 121 next sets, flip-flop 155 is reset by way of the output from NAND gate 136 appearing on conductor 150. With flip-flop 155 reset, the NOR gate 157 produces a low output (waveform H), thereby inhibiting the BCD inputs. At the same time, NOR gate 139 produces a low output which enables the main counter 140. Because flip-flop 159 is now reset, the counter contained within IC chip 140 starts operation in the decrement mode. That is, as count pulses are received at pin 36 from the output of NOR gate 172, the value initially entered into the counter will be reduced.

Count pulses from stage $Q_2$ of the phase-locked loop feedback counter 83 propagate through NOR gate 170 and 172 causing the main counter 140 to decrement for each 4° of rotation during the timing interval defined by the ignition and the reference signals. Flip-flop 121 controls the Count Inhibit inut to the counter/display decoder 140 to perform intermittent counting over the entire measurement cycle, shown in diagram I. The measurement cycle is comprised of 40 ignition cycles. Thus, there will be a total of 40 counts for every 4° of timing angle. The measurement cycle is completed when counter 119 again resets.

If ignition occurs after Top Dead Center, the residual count remaining in the counter 140 upon the resetting of counter 119 corresponds to 10 times the negative timing angle in that the shaft angle over which the decrementing was done was less than the reference angle and each count has a weight of 0.1°. It is desirable that this residual value be displayed as a signed integer in degrees. To accomplish this end, the output from NAND gate 152 clocks flip-flop 161 by way of connection 162 coincident with the store operation taking place within the main counter 140. The flip-flop 159 has remained reset and therefore the $\overline{Q}$ output of flip-flop 161 will be high. The digit strobe pulse $D_4$ (pin 27) will therefore cause NAND gate 164 to produce a low output, turning on PNP transistor 215 at the same time that transistor 209 is on. With transistors 215 and 209 conducting current will flow through the resistor 225 and the horizontal segment *g* of LED display stage 166 to form an illuminated horizontal dash (minus sign) as shown in FIG. 2. Stage 167 of the LED display register 165 dislays digit 1 of the counter 140, corresponding to the tens of degrees while LED display stage 168 presents digit 5 of the counter 140 corresponding to the units of degrees. It is also to be noted that transistor 212 is switched off at the time since the mode switch is no longer connecting conductor 116 to the +V supply. Hence the LED display stage 169 is disabled. The reading of the display device 165 will thus be −15.

If the timing angle is positive, the main counter 140 will decrement through zero, causing a carry pulse to appear at pin 38 which is applied to the clock input of flip-flop 159. This forces flip-flop 159 to its set state, thus changing the main counter mode from decrement to increment. Subsequent count pulses from NOR gate 172 result in a residual count which is ten times the positive timing angle. With flip-flop 159 now set, when flip-flop 161 is clocked, the Q output will go low, disabling NAND gate 164 and turning off transistor 215. Hence, segment *g* of LED display stage 166 will be extinguished, i.e., the minus sign will be removed so that the operator will know that the timing is advanced by the amount of the numeral displayed on display device 165.

TACHOMETER MODE

The tachometer mode functions somewhat similar to the timing mode described above. However, the following exceptions prevail:

1. The Load Reference Count command (pin 31 of counter 140) is inhibited;
2. The main counter 140 is always in the increment (Up) mode;
3. Counting is continuous over the measurement cycle;
4. The measurement interval is a fixed time period instead of a fixed number of revolutions; and
5. The count rate from NOR gate 172 is reduced to 90 pulses per timing cycle rather than 180 pulses per timing cycle.

In the tachometer mode, the switch $SW_1$ will be in position 1 and a positive voltage will be applied via conductor 116 to the tach bus 115. This positive voltage is applied to the base electrode of transistor 212 and turns it on to enable LED display register stage 169 to function and display a "dummy" zero. The positive voltage on the tach bus also is applied to flip-flop 159 and gates 113, 157, and 170, and its logical inverse (output of inverter 174) is applied to flip-flop 121 and gates 138 and 171. This enables gates 113, 138 and 171 and blocks gates 157 and 170. It also holds flip-flop 121 in its reset state and holds flip-flop 159 in its set state. The tachometer oscillator 102 is a free-running circuit which produces a negative-going pulse train at the collector electrode of its output transistor 111 at a frequency of 29.25 Hz. These pulses are applied to NAND gate 113. With flip-flop 121 reset, these pulses from the tach oscillator are able to propagate through NAND gate 118 to clock the divide-by-40 counter 119. As in the timing mode, a reset of counter 119 causes NAND gate 136 to output a low signal (waveform G) which initiates the same sequence of Set, Store, and Clear in the main counter IC chip 140 (waveforms K through R). During this interval, NAND gate 135 is also outputting a low signal so that NOR gate 139 is outputting a high signal, thereby inhibiting counting at pin 37.

The output from stage $Q_3$ of the phase-locked loop feedback counter 83 propagates through NOR gates 171 and 172 so that 90 counts will be accumulated for each timing cycle. When the counter 119 is incremented, NAND gate 135 will produce a high signal which enables the main counter. The main counter 140 advances continuously until counter 119 again resets thereby defining a measurement interval of $1\frac{1}{8}$ seconds, as is shown in waveform J. The resulting count in the main counter 140 is equal to the average speed of the engine shaft in revolutions per minute. The thousands, hundreds and tens digits are displayed in the LED display device 165, i.e., in stages 166, 167 and 168, respectively. Segments a through *f* of stage 169 of the LED display are illuminated by the constant currents through resistors coupled between the +V' source and the input pins of the stage. This has the effect of generating a constant zero symbol in the least significant decimal digit stage of the display device 165, thereby providing round off of the units digit. The resistors associated with stage 169 are chosen relative to the resistors 222 through 225 to accommodate the difference in duty cycle and to achieve equal average current and therefore equal luminance for all of the LED segments a through *f*.

To provide a visual indication that the inductive probe 36 is properly in place on the spark plug wire for the No. 1 plug, the output of the one-shot circuit 48 responsive to the signal from the No. 1 plug, is connected by way of conductor 120 and resistor 221 to pin 5 of the LED display stage 169 which controls the display of a decimal point 226. Because the one-shot 48 produces pulses intermittently, the decimal point indicator 226 will blink, thus providing an indication that the ignition probe is properly connected.

Thus it can be seen that there is provided by the present invention apparatus which permits an operator to accurately measure the rotational velocity of the engine as well as engine timing based upon measurement of the advance or retard of the firing of a spark plug with respect to a reference angle derived from the Top Dead Center position of the piston for the No. 1 cylinder. The apparatus of the present invention may be used with a variety of engines in that means are provided for selectively entering a variety of reference angles. Because of the simplicity in the operator steps and the high precision of measurement afforded by the electronic design of the present invention, an operator of very little training is able to accurately adjust the engine's timing to meet manufacturer's specifications.

While there has been shown and described a specific embodiment of the present invention for purposes of illustration, it is to be understood that the scope of the invention is limited solely by the appended claims.

I claim:

1. Apparatus for measuring the ignition timing of a multi-cylinder internal combustion engine having a rotating crankshaft, electrical signal generating means located adjacent a rotating member driven by said crankshaft to indicate when said crankshaft is in a predetermined position subsequent to the top dead center position of the crankshaft, a plurality of igniters, one for each cylinder, and means for periodically and successively energizing said igniters, said apparatus comprising:

ignition signal means adapted to be connected to that one of said igniters which is energized closest to the time at which said crankshaft is in a top dead center position to produce a first electrical signal when said igniter is energized, reference signal means adapted to be connected to said electrical signal generating means to produce a second electrical signal when said crankshaft is in the predetermined position having a fixed relationship subsequent to the top dead center position of the crankshaft, means to generate a pulse train having a constant number of pulses per engine revolution, a counter connected to said pulse train generating means for counting the pulses produced thereby, means connected to said ignition signal means for initiating said counting operation in response to said first electrical signal when said one igniter is energized regardless of whether said igniter is energized prior to or subsequent to said top dead center position, means connected to said reference signal means for terminating said counting operation in response to said second electrical signal when said crankshaft is in said predetermined position and for maintaining said counting operation ineffective until said one igniter is again energized, compensating means connected to said counter for compensating the operation of said counter in accordance with the reference angle between said predetermined position of the crankshaft and the top dead center position thereof, and indicating means connected to said counter for indicating the extent and direction that the position of the crankshaft at which said one igniter is energized differs from the related top dead center position of the crankshaft.

2. The apparatus of claim 1 in which said compensating means comprises a selector switch having a plurality of switching positions each corresponding to a desired reference angle and connections from said switching means to various inputs to said counter to preset said counter in accordance with the selected reference angle.

3. The apparatus of claim 1 in which there is a selector switch movable between a timing measurement position in which ignition timing is measured and a tachometer position in which engine speed is measured and in which when said selector switch is in said tachometer position, the pulses are counted for a predetermined period of time rather than the ignition signal to the reference signal.

4. The apparatus of claim 1 in which there is a selector switch movable between a timing measurement position in which ignition timing is measured and a tachometer position in which engine speed is measured and in which said indicating means includes at least three digital displays all of which are used to provide numerical displays when said selector switch is in said tachometer position and only two of which are used to provide numerical displays when said selector switch is in said timing measurement position.

5. The apparatus of claim 4 in which said digital display units are each formed of a plurality of indicating bars and in which when said selector switch is in said timing measurement position and the number of pulses between the ignition signal and the reference signal is less than the number of pulses corresponding to the reference angle, a horizontal center bar of the third numeral is activated to display a minus sign.

6. The apparatus of claim 5 in which said digital display units are each formed of a plurality of bar shaped light emitting diodes.

7. The apparatus of claim 1 in which said indicating means includes a light and means for energizing said light each time that said ignition signal means produces an electrical signal to indicate that said ignition signal means is properly connected to said one igniter.

8. The apparatus of claim 1 in which said means to generate a pulse train includes phase locked loop comprising a voltage controlled oscillator and a phase comparator.

9. The apparatus of claim 1 in which there is a hold switch and means connected to said hold switch and said counter effective when said hold switch is moved to hold position to prevent said counter from changing the indication provided by said indicating means.

10. The apparatus of claim 1 in which said counting operation is repeated for a plurality of cycles of engine operation before said indicating means is effective to indicate the ignition timing.

* * * * *